US006629565B2

(12) United States Patent
Harrell

(10) Patent No.: US 6,629,565 B2
(45) Date of Patent: Oct. 7, 2003

(54) ABANDONMENT AND RETRIEVAL APPARATUS AND METHOD

(75) Inventor: Danny H. Harrell, Lafayette, LA (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/911,294

(22) Filed: Jul. 23, 2001

(65) Prior Publication Data

US 2002/0060076 A1 May 23, 2002

Related U.S. Application Data

(60) Provisional application No. 60/220,293, filed on Jul. 24, 2000.

(51) Int. Cl.[7] ..... E21B 29/12

(52) U.S. Cl. ..... 166/361; 166/55.7; 166/298; 166/178

(58) Field of Search ..... 166/55.7, 298, 166/361, 98, 376, 377, 170; 169/69

(56) References Cited

U.S. PATENT DOCUMENTS

| | | | | |
|---|---|---|---|---|
| 1,358,818 | A | 11/1920 | Bering | |
| 1,460,894 | A | 7/1923 | Dix | |
| 2,304,330 | A | 12/1942 | Bannister | 164/0.7 |
| 2,622,679 | A | 12/1952 | Ransom | 164/0.7 |
| 2,859,943 | A | 11/1958 | Chadderdon | 255/76 |
| 2,880,804 | A | 4/1959 | Fredo | 166/55.8 |
| 3,075,582 | A | 1/1963 | Morse et al. | 166/16 |
| 3,332,492 | A | 7/1967 | Thomas | 166/55.1 |
| 3,419,077 | A | 12/1968 | Sanford | 166/55.8 |
| 3,489,211 | A | 1/1970 | Kammerer, Jr. | 166/0.5 |
| 3,920,070 | A | 11/1975 | Goins | 166/55.8 |
| 3,983,936 | A | 10/1976 | Kennard et al. | 166/0.5 |
| 4,003,433 | A | 1/1977 | Goins | 166/298 |
| 4,047,568 | A | 9/1977 | Aulenbacher | 166/298 |
| 4,144,936 | A | 3/1979 | Evans | 166/298 |
| 4,191,255 | A | 3/1980 | Rives | 166/297 |
| 4,550,781 | A | 11/1985 | Kagler, Jr. | 166/340 |
| 4,646,826 | A | 3/1987 | Bailey et al. | 166/55.3 |
| 4,662,436 | A | 5/1987 | Parra et al. | 166/55.6 |
| 4,703,802 | A | 11/1987 | Bryan et al. | 166/298 |
| 4,768,899 | A | 9/1988 | Dysarz | 405/195 |
| 4,809,775 | A | 3/1989 | Fortin | 166/55.7 |
| 4,856,938 | A | 8/1989 | Kuehn | 405/227 |
| 4,883,118 | A | 11/1989 | Preston | 166/55.3 |
| 4,969,514 | A | 11/1990 | Morris et al. | 166/55 |
| 5,014,780 | A | 5/1991 | Skipper | 166/55.8 |
| 5,150,755 | A | 9/1992 | Cassel et al. | 166/297 |
| 5,253,710 | A | 10/1993 | Carter et al. | 166/298 |
| 5,253,714 | A | 10/1993 | Davis et al. | 166/376 |
| 5,318,115 | A | 6/1994 | Rouse | 166/55.7 |
| 5,735,359 | A | 4/1998 | Lee et al. | 175/269 |
| 5,791,409 | A | 8/1998 | Flanders | 166/55.8 |
| 5,899,268 | A | 5/1999 | Lynde et al. | 166/55.6 |
| 6,029,745 | A * | 2/2000 | Broussard et al. | 166/298 |
| 6,070,670 | A * | 6/2000 | Carter et al. | 166/242.7 |
| 6,330,919 | B1 * | 12/2001 | McGarian | 166/298 |
| 6,357,528 | B1 * | 3/2002 | Davis et al. | 166/298 |

* cited by examiner

*Primary Examiner*—Robert E. Pezzuto
*Assistant Examiner*—Thomas A. Beach

(57) ABSTRACT

A well abandonment process for cutting and retrieving an offshore well casing, the process comprising: making a trip to the well wherein all of the following steps are performed, the steps comprising: pulling a seal assembly from the wellhead, cutting the casing, griping the casing, and retrieving the seal assembly and cut casing. An apparatus for cutting and retrieving an offshore well casing, the apparatus comprising: a seal assembly retrieval tool for releasing a seal assembly of the well casing, wherein the seal assembly retrieval tool is connectable to a drill string for suspension from the drill string; a first bumper jar in mechanical communication with the seal assembly retrieval tool; a spear in mechanical communication with the first bumper jar, wherein the spear is engageable with the well casing; a second bumper jar in mechanical communication with the spear; a mud motor in mechanical communication with the second bumper jar; and a casing cutter in mechanical communication with the mud motor, wherein the casing cutter is driven by the mud motor to cut the well casing.

12 Claims, 9 Drawing Sheets

ABANDONMENT AND RETRIEVAL APPARATUS AND METHOD

REFERENCE TO PRIOR APPLICATION

This application claims the benefit of U.S. Provisional Application No. 60/220,293, filed Jul. 24, 2000.

BACKGROUND OF THE INVENTION

The present invention relates to methods and apparatus for deep water plug and abandonment systems used on the mineral production industry. Prior art systems typically require at least four (4) trips to the wellhead to cut and retrieve casing for abandonment of the well. In the first trip, the wear bushing is pulled. In the second trip, a device is used to engage the seal assembly and pull the seal assembly to the surface. In the third trip, a device is used to engage a spear to grip the casing, a cut is made in the casing with a rotary driven cutter, the top portion of the cut casing is pulled up through the riser. In the fourth trip, cement plugs are set for isolation.

Several systems for cutting and pulling the casing and well head to the surface of the water are known in the industry. The following are a few examples.

U.S. Pat. No. 3,983,936, herein incorporated by reference, discloses a method of and apparatus for cutting and recovering submarine surface casing and associated equipment on the ocean floor. It includes the steps of lowering a string into the surface casing which string includes a swivel, a spear and a cutter, seating the swivel on the casing well head seat, actuating the cutter to sever the casing, setting the spear within the casing and recovering the surface casing and well head equipment associated therewith.

U.S. Pat. No. 4,703,802, herein incorporated by reference, discloses a cutting and recovery tool for a well-head, having a housing which is adapted to engage with a side wall of the wellhead to lock them together, and a mandrel extending through the housing and rotatable relative to the housing and adapted to carry a radially-acting cutter which severs the wellhead below the area of engagement of the housing. This allows the wellhead to be severed and withdrawn in a single operation.

U.S. Patent No. 4,550,781, incorporated herein by reference, discloses a method of cutting and retrieving submarine well casing which includes the steps of lowering a tool on a string into the bore of the well casing which tool includes a casing cutter, a bumper sub connecting from the cutter to the combined anchor swivel and latching means to retain the anchor in unset position when it is being run with the string connected to the upper end of the tool, landing the tool with the swivel supported on the upper end of the casing and the remainder of the tool within the casing, releasing the latching means, raising the string to set the anchor, tensioning the string, energizing the cutter arms, rotating the string to cut the casing, and raising the string to retrieve the cut casing. The apparatus includes a casing cutter, a bumper sub, a combined anchor swivel and latching means to retain the anchor in unset position which latching means is actuated to unlatched position by manipulation of the string on which the tool is supported.

U.S. Pat. No. 4,144,936, incorporated herein by reference discloses an apparatus for milling metal submerged in salt water or within a hole, such as cutting off the upper ends of pipes and casings in a well-drilling operation below the sea floor. A hydraulic motor is suspended in the hole and driven by sea water to rotate an electrical generator and to rotate a cutting tool. The tool includes radially movable, electrically conductive elements which form the cathodes of an electrochemical machining operation for removing metal. The tool elements include abrasive material so that they can mechanically cut through cement.

U.S. Pat. No. 5,318,115, incorporated herein by reference, discloses a casing cutting and retrieving tool is described which includes a grapple device for mechanically gripping casing to be retrieved. A mud motor having upper and lower stators and a rotor is also provided. The upper stator acts as a suspension device for suspending the grapple device from a drill string, and the upper stator is mechanically fast with the grapple device. A rotary cutter depends from a drive end of the rotor and is rotatable by the rotor to cut the casing at a location below the grapple device.

However, in all prior art systems it is necessary to make a separate trip with the working string to engage the seal assembly in the wellhead and pull the seal assembly to the surface. This trip, like all trips, requires time and money. Therefore, there is a need for a plug and abandonment system which does not require a separate trip to pull the seal assembly from the wellhead.

SUMMARY OF THE INVENTION

The present invention provides a seal assembly retrieval device which is incorporated with casing cutter and spear devices to create a system which does not require a separate trip to pull the seal assembly.

According to one aspect of the invention there is provided a well abandonment process for cutting and retrieving an offshore well casing, the process comprising: making a trip to the well wherein all of the following steps are performed, the steps comprising: pulling a seal assembly from the wellhead, cutting the casing, griping the casing, and retrieving the seal assembly and cut casing.

According to another aspect of the invention, there is provided an apparatus for cutting and retrieving an offshore well casing, the apparatus comprising: a seal assembly retrieval tool for releasing a seal assembly of the well casing, wherein the seal assembly retrieval tool is connectable to a drill string for suspension from the drill string; a spear in mechanical communication with the seal assembly retrieval tool, wherein the spear is engageable with the well casing; a mud motor in mechanical communication with the spear; and a casing cutter in mechanical communication with the mud motor, wherein the casing cutter is driven by the mud motor to cut the well casing.

According to still another aspect of the invention, there is provided an apparatus for cutting and retrieving an offshore well casing, the apparatus comprising: a seal assembly retrieval tool for releasing a seal assembly of the well casing, wherein the seal assembly retrieval tool is connectable to a drill string for suspension from the drill string; a first bumper jar in mechanical communication with the seal assembly retrieval tool; a spear in mechanical communication with the first bumper jar, wherein the spear is engageable with the well casing; a second bumper jar in mechanical communication with the spear; a mud motor in mechanical communication with the second bumper jar; and a casing cutter in mechanical communication with the mud motor, wherein the casing cutter is driven by the mud motor to cut the well casing.

In some embodiments of the invention, it is preferred to cut the casing while the casing is under tension. Since the spear is engaged with the casing before the casing is cut, the operator may lift up on the tool so as to induce an upward force on the casing. This action takes the weight of the casing off the portion of the casing being cut.

BRIEF DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
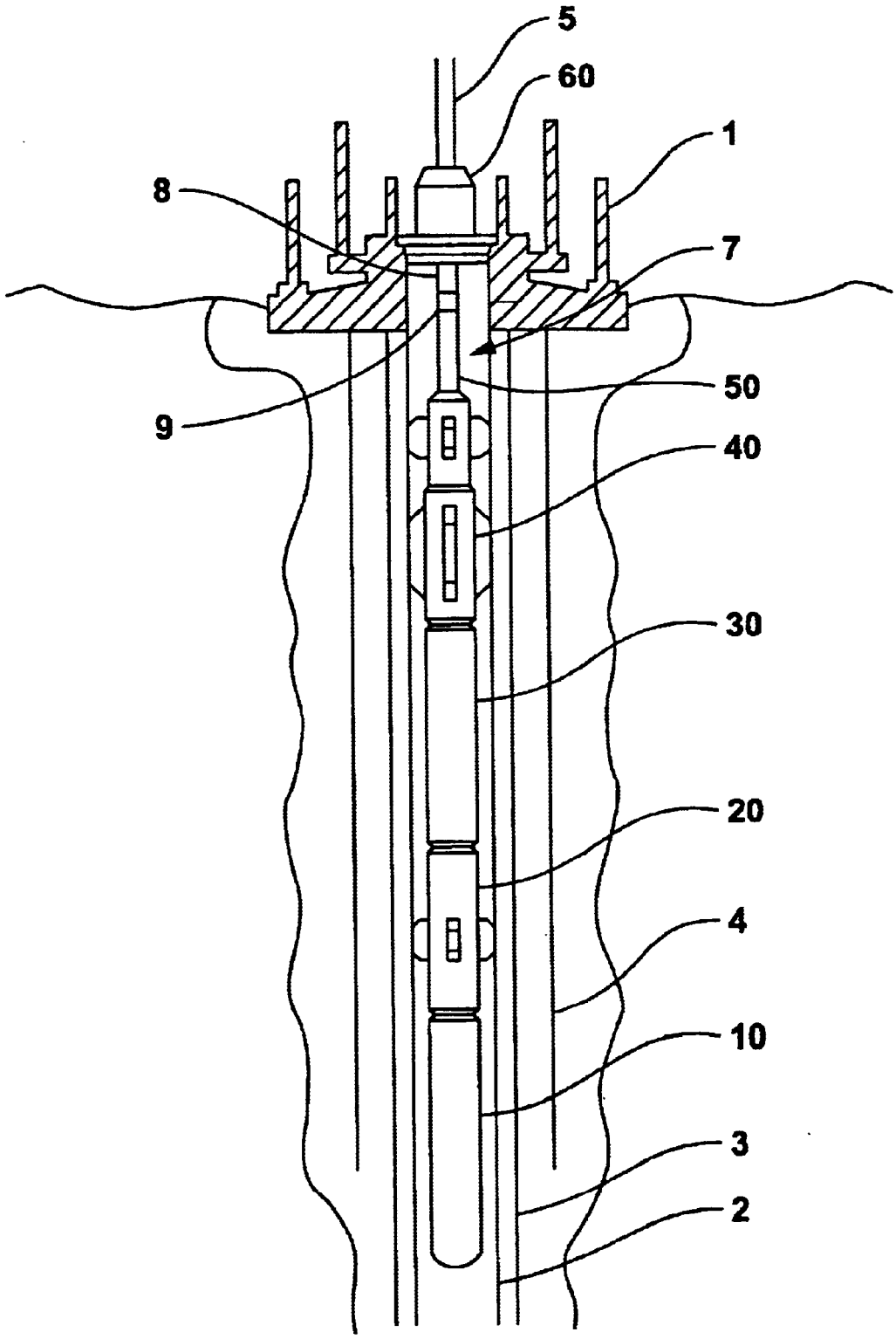
FIG. 1 is a side view of a cut/retrieval tool positioned within a well casing with a seal assembly retrieval tool positioned in the wellhead.
Figure 2:
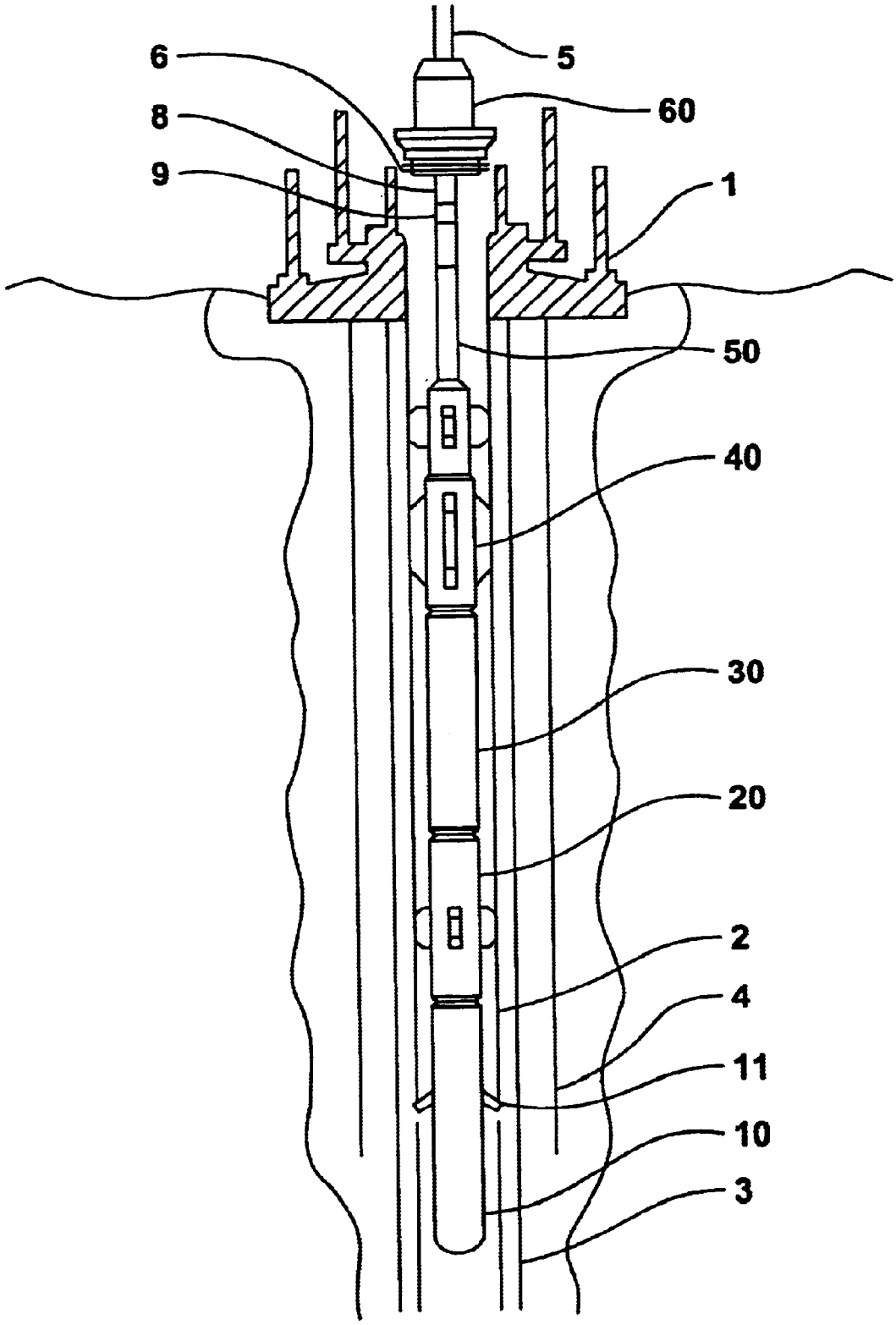
FIG. 2 is a side view of a cut/retrieval tool positioned within a well casing with the seal assembly pulled from the wellhead and engaged by the seal assembly retrieval tool and an interior casing is cut by a casing cutter.
Figure 3:
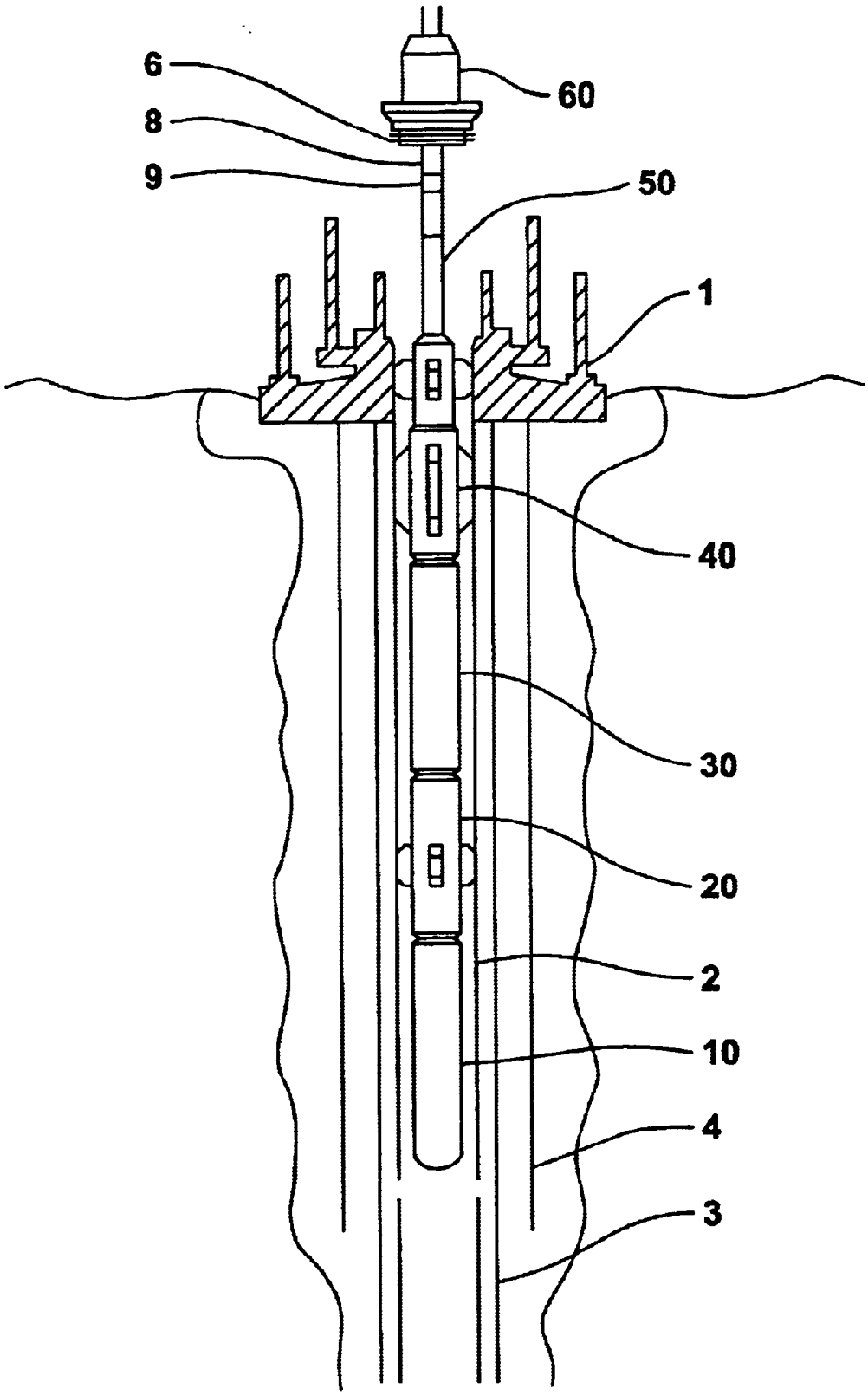
FIG. 3 is a side view of a cut/retrieval tool positioned within a well casing with a spear positioned just below the wellhead for engaging the cut casing.
Figure 4:
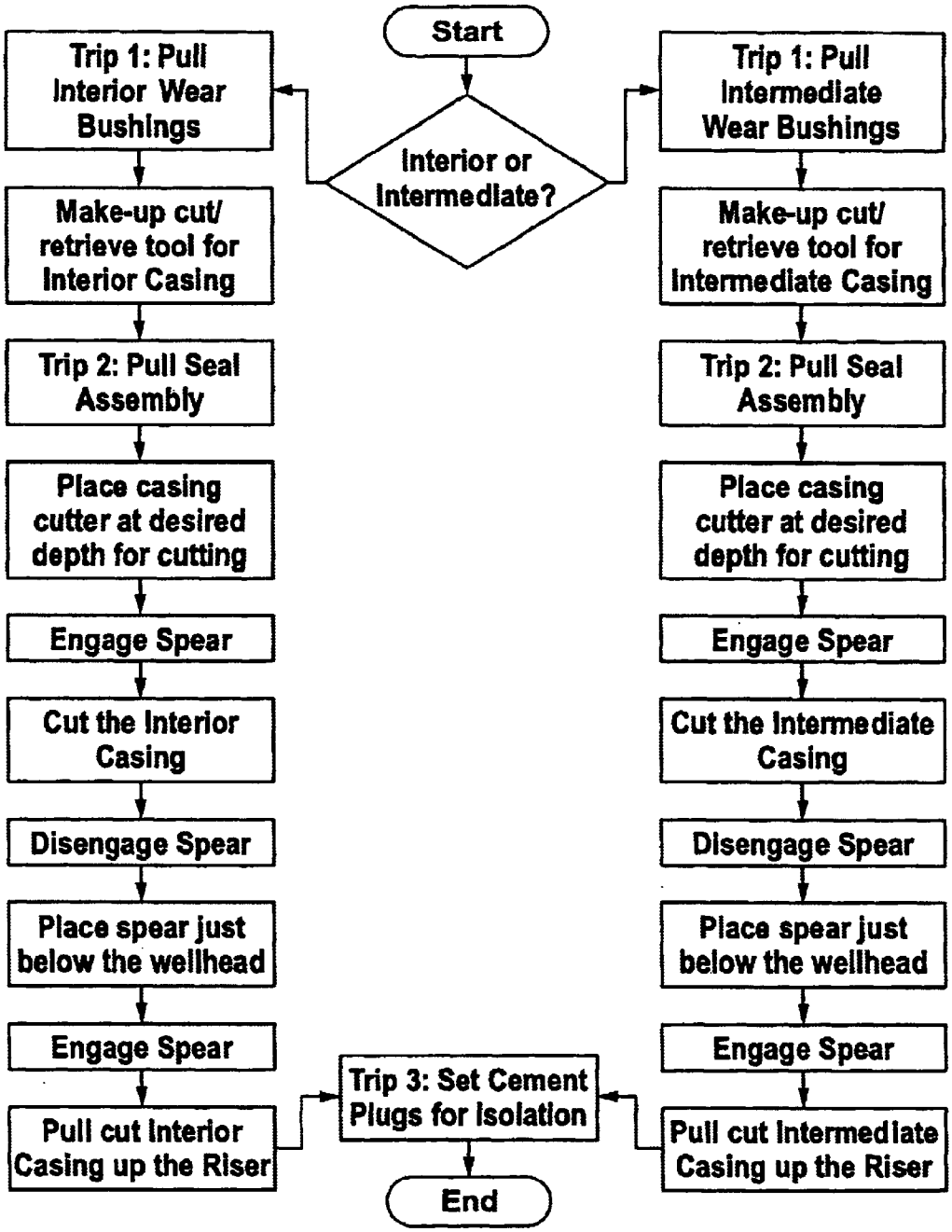
FIG. 4 is a flow chart for a process for cutting and retrieving casing from a well to be abandoned.

Referring to FIG. 1, a side view of an embodiment of the invention is shown for a cut/retrieval tool 7. A wellhead 1 is shown atop three concentric casings: the interior casing 2, the intermediate casing 3 and the exterior casing 4. In a typical well, the interior casing 2 has a diameter of 9⅞ inches, the intermediate casing 3 has a diameter of 13⅝ inches, and the exterior casing 4 has a diameter of 20 inches. The cut/retrieval tool 7 is suspended from an offshore vessel or platform (not shown) by a drill pipe 5. The cut/retrieval tool 7 is connected to the drill pipe 5. At the top of the cut/retrieval tool 7, there is a seal assembly retrieval tool 60, which is used to pull the seal assembly of the interior casing 2 or intermediate casing 3 in the wellhead 1. Below the seal assembly retrieval tool 60, the cut/retrieval tool 7 also has a bumper jar 50, a spear 40, a long stroke bumper jar 30, a mud motor 20 and a casing cutter 10, all connected to each other in series in the order given.

Referring to FIGS. 1–4, a process for retrieving an interior casing 2 is described. The process of the present invention may be used to cut and pull either the interior casing 2 or the intermediate casing 3. To cut and pull the intermediate casing 3, the interior casing 2 must have been previously retrieved. A retrieval of the interior casing 2 is described in the figures as an illustration. According to the present invention, only three trips are necessary to pull a casing string. In the first trip, the wear bushing is pulled from the wellhead. In the second trip, a cut/retrieval tool 7 is used which comprises: a hydraulic casing cutter 10, a high torque low speed mud motor 20, a long stroke bumper jar 30, a spear 40, a bumper jar 50, a drill collar 8 with two stands minimum, drill pipe space out 9, a seal assembly retrieval tool 60, and drill pipe to the surface 5. The seal assembly retrieval tool 60 engages the seal assembly and pulls the seal assembly from the wellhead (see FIG. 1), the cut/retrieval tool 7 is pulled up 90'–100' to place the casing cutter 10 at the desired cutting depth, i.e. 1000', the spear 40 is engaged by operation of a J-mechanism to grip the casing, the interior string is cut (see FIG. 2), the spear 40 is disengaged by operation of the J-mechanism, the cut/retrieval tool 7 is pulled out of hole until the spear 40 is immediately below the well head 1, the spear 40 is engaged to grip the casing by operation of the J-mechanism (see FIG. 3), the tool is pulled with the top 1000' of the cut interior casing 2 up through the riser (not shown), the interior casing 2 is suspended in the rotary table (not shown), the spear 40 and all the devices down to the casing cutter 10 are released and racked on the derrick, and the 1000' of cut interior casing 2 are laid down. In the third trip, cement plugs are set for isolation.

While a particular cut depth is indicated in the prior procedure, it is to be understood that the invention may be used at a wide range of cut depths. The particular configuration and size of the cut/retrieval tool depends on the well in which the casing is to be cut.

According to one embodiment of the invention, the procedure for operation of the system is as follows. Trip in the hole until the seal assembly retrieving tool 60 is about to the seal in the wellhead 1 (see FIG. 1). It is important to allow for enough space out to strip seal assembly to riser (not shown). Next, engage the seal assembly with the seal assembly retrieval tool 60. Then pull the seal assembly 6 and the cut/retrieval tool 7 up into riser (see FIG. 2). The casing cutter 10 is then spotted at the desired cutting depth. With the casing cutter in the correct location, a slight left-hand torque is applied to engage the spear 40 (¼ turn) to grip the casing. The casing 2 or 3 is then cut and the spear 40 is disengaged by a right-hand torque to release its grip on the casing. The cut/retrieval tool 7 is then pulled out of the hole until the spear 40 is just below the wellhead 1. A left-hand torque is then applied to engage the spear 40 to grip the casing. Next, the cut/retrieval tool 7 is pulled out of the hole with the casing 2 or 3. The seal assembly 6 and seal assembly retrieval tool 60 are then laid out at the surface. The cut/retrieval tool 7 is then pulled further out of the hole until the casing hanger is landed out on rotary table. It should be spaced out so that the spear 40 can be racked in the derrick. The spear 40 is then disengaged and racked back in the derrick. Finally, the casing is rigged up and laid down on the derrick.

Since the spear 40 is engaged to grip the casing 2 or 3 before the casing is cut with the casing cutter 10, the casing 2 or 3 may be cut in tension. In particular, with the spear 40 engaged, the operator of the cut/retrieval tool 7 may pull up on the drill pipe 5 so that the casing experiences an applied pressure in tension. With tension pressure applied to the casing 2 or 3 during the cutting procedure, the chances of a successful cut are greatly increased. Once the seal assembly 6 is pulled the casing 2 or 3 may be cut with the spear 40 at any depth below the wellhead 1.

The seal assembly retrieval tool 60 may be any retrieval device that is known in the industry which is capable of engaging, releasing and pulling the seal assembly of the casing hanger in the wellhead 1. Since different seal assemblies are manufactured by different vendors, each having different designs, it is necessary to use a seal assembly retrieval tool 60 which mates with the seal assembly of the well being worked.

Figure 5:
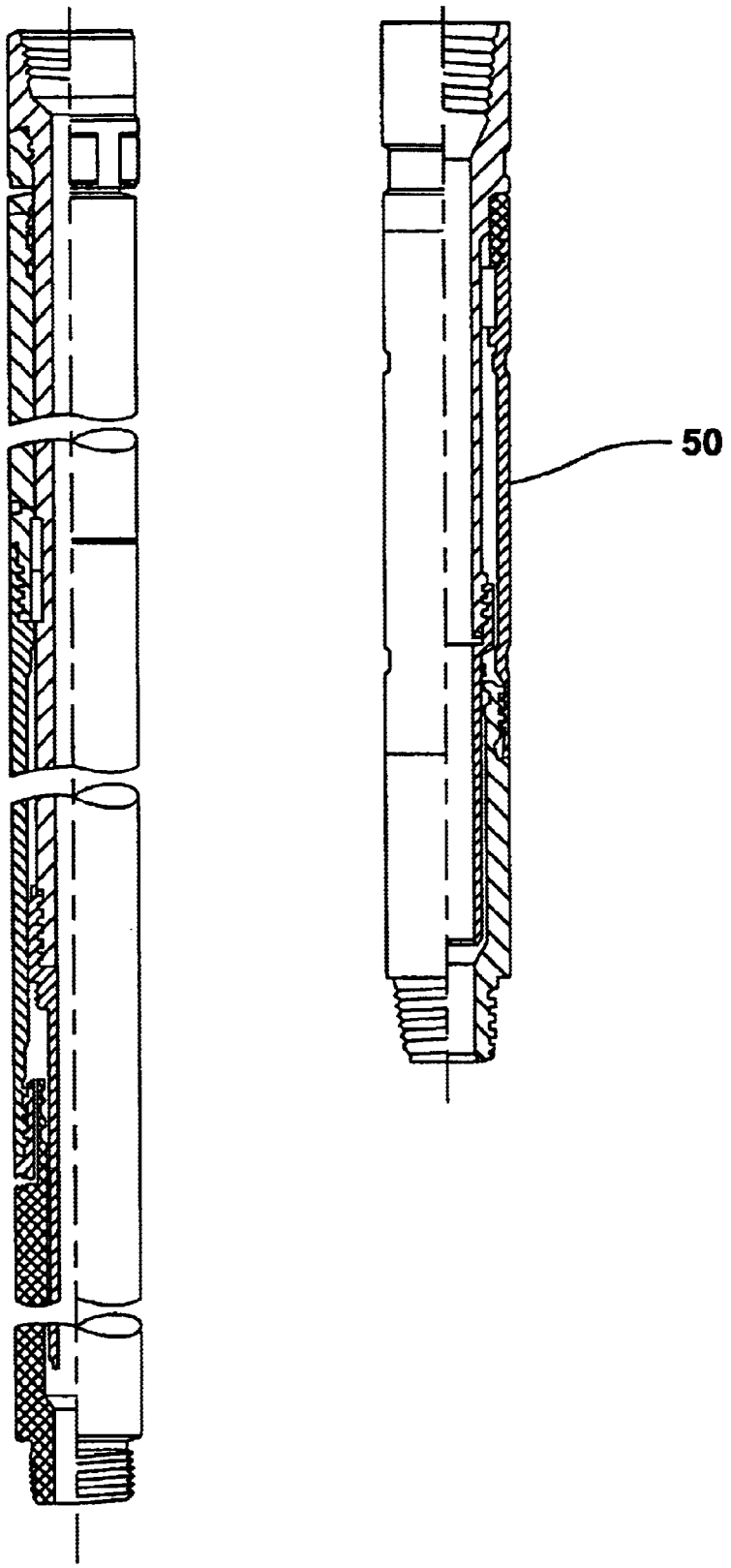
FIG. 5 is a cross-sectional side view of a bumper jar used in the present invention.

The bumper jar 50 may be any bumper jar that is known in the industry. In a preferred embodiment, the upper bumper jar 50 has an eighteen (18) inch stroke. According to some embodiments of the invention, the bumper jar is a Houston Engineers, Inc. (HE) Drilling and Fishing Bumper Sub. The Houston Engineers, Inc. Drilling (EBL) and Fishing (EBD, EBL) Bumper Subs have strokes of 10, 16 and 18 inches and positive sealing. HE Bumper subs are furnished with either a non-lubricated or lubricated drive system. A cross-sectional side view of an illustrative bumper jar 50 is shown in FIG. 5.

Figure 6:
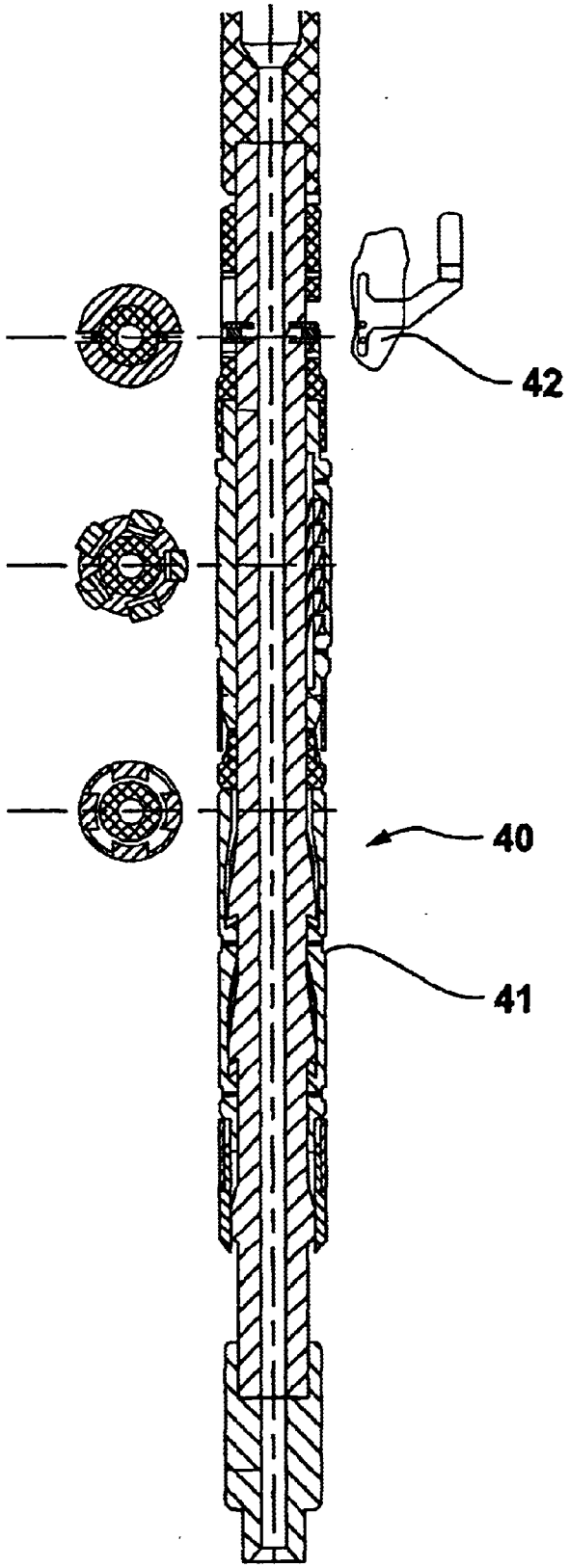
FIG. 6 is a cross-sectional side view of a spear used in the present invention.

The spear 40 may be any casing gripping device that is known in the industry. According to one embodiment of the invention, the spear 40 is a device as shown in FIG. 6. The spear 40 has slip elements 41 which engage the casing. Is also has a J-mechanism 42 which locks and unlocks the spear 40.

Figure 7:
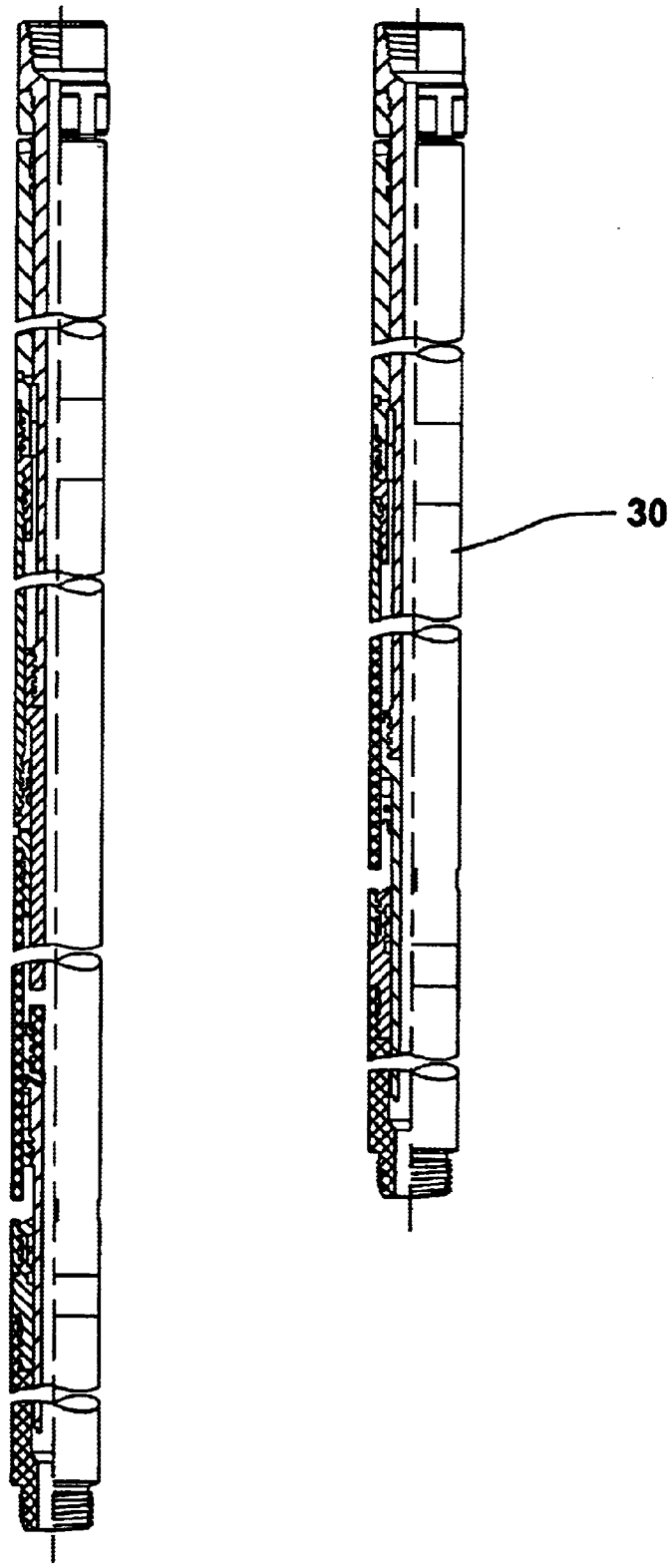
FIG. 7 is a cross-sectional side view of a bumper jar used in the present invention.

The long stroke bumper jar 30 may be any bumper jar that is known in the industry. In one embodiment of the invention, the long stroke bumper jar 30 is the HE Hydra-Stroke® Drilling Bumper Sub as shown in FIG. 7. The HE Hydra-Stroke® Drilling Bumper Sub provides telescopic movement or stroke in a drilling string. All drilling bumper subs may be sealed and lubricated for long, economical life. The partially balanced subs provide a minimum "pump open" characteristic. The design is midway between the unbalanced and fully balanced sub. The fully balanced sub eliminates the effect of internal pressures. In a preferred embodiment, the long stroke bumper jar 30 has a six (6) foot stroke.

If the casing being cut is about 9⅞ inches in diameter, an acceptable motor 20 is the DRILEX D675, having an overall length of 21 feet and an outside diameter of 6¾ inches. The DRILEX D675 also has a 9–10 configuration with two stages and a flow rate between 200 and 650 GPM to produce max torque of 5,400 FT.-LBS. A motor of this type should be operated within the following ranges with the tool.

| GPM @ Motor | GPM @ Tool | PSI @ Tool | RPM @ Tool | Motor Torque | PSI Differential |
|---|---|---|---|---|---|
| 200 | 190 | 66 | 56–23 | 900–4,000 | 100–500 |
| 300 | 285 | 149 | 86–55 | 900–4,000 | 100–500 |
| 400 | 380 | 265 | 113–45 | 900–5,400 | 100–700 |
| 500 | 475 | 415 | 143–77 | 900–5,400 | 100–700 |
| 600 | 570 | 597 | 169–113 | 900–5,400 | 100–700 |
| 650 | 617 | 700 | 186–130 | 900–5,400 | 100–700 |

These PSI's are gained by using a total TFA of 0.742 or one 22 jet, one 22 jet and 11# as mud wt.

If the casing being cut is about 13⅝ inches in diameter, an acceptable motor 20 is the DRILEX D775, having an overall length of 21 feet and an outside diameter of 7¾ inches. The DRILEX D775 also has a 9–10 configuration with two stages and a flow rate between 200 and 650 GPM to produce max torque of 5,400 FT.-LBS. A motor of this type should be operated within the following ranges with the tool.

| GPM @ Motor | GPM @ Tool | PSI @ Tool | RPM @ Tool | Motor Torque | PSI Differential |
|---|---|---|---|---|---|
| 200 | 190 | 47 | 56–23 | 900–4,000 | 100–500 |
| 300 | 285 | 104 | 86–55 | 900–4,000 | 100–500 |
| 400 | 380 | 187 | 113–45 | 900–5,400 | 100–700 |
| 500 | 475 | 293 | 143–77 | 900–5,400 | 100–700 |
| 600 | 570 | 422 | 169–113 | 900–5,400 | 100–700 |
| 650 | 617 | 494 | 186–130 | 900–5,400 | 100–700 |

These PSI's are gained by using a total TFA of 0.884 one 24 jet, one 24 jet and 11# as mud wt.

Figure 8:
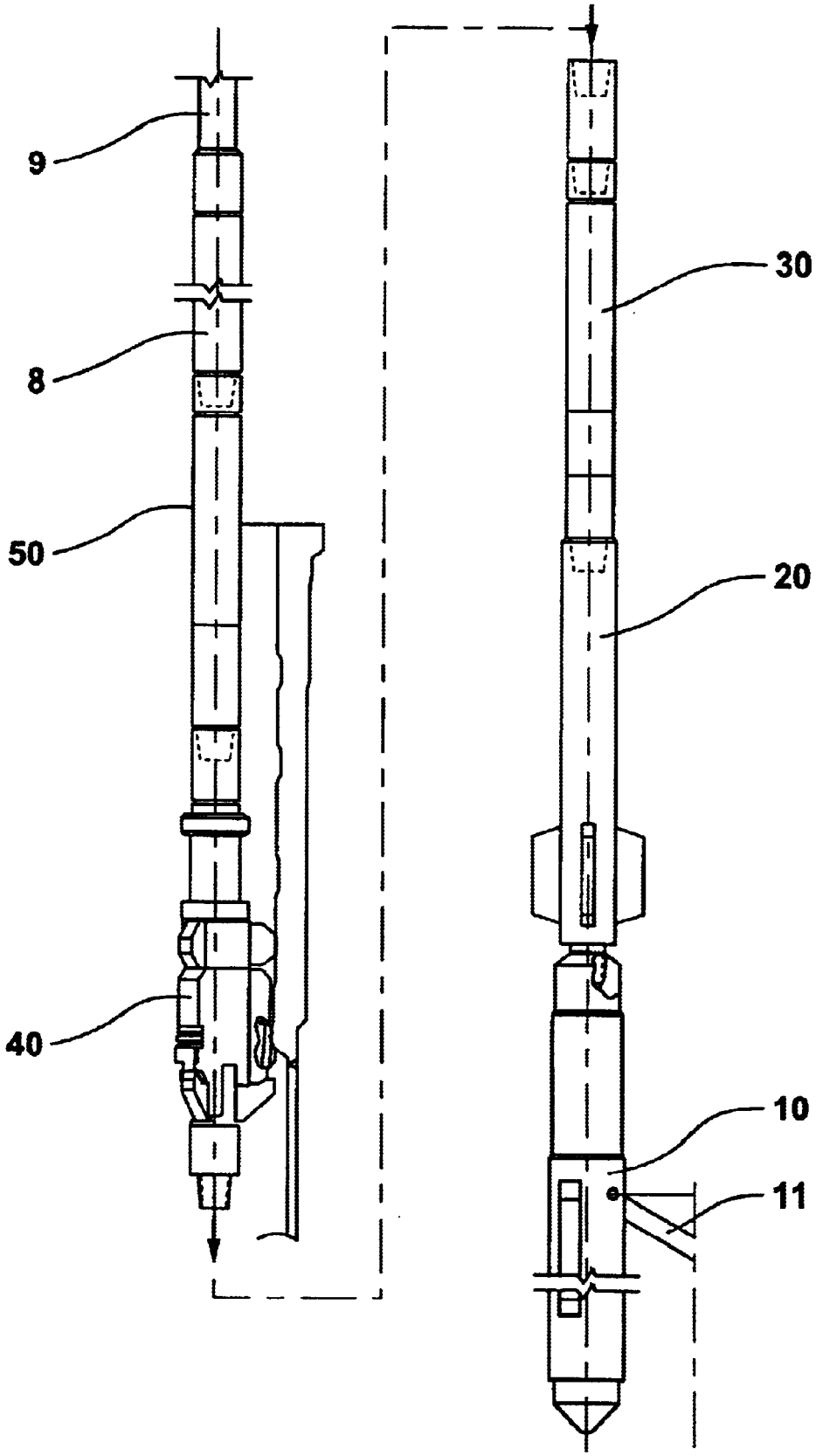
FIG. 8 is a side view of a portion of a cut/retrieval tool, wherein the portion has a casing cutter, a mud motor, a mud motor bumper jar, a spear, a spear bumper jar, a drill collar and a drill pipe space out.

The casing cutter 10 may be any casing cutter that is known in the industry. A suitable casing cutter 10 is shown in FIG. 8. The casing cutter 10 has retractable blades 11 for cutting the casing. FIG. 8 also shows embodiments of a mud motor 20, a long stroke bumper jar 30, a spear 40, a bumper jar 50, drill pipe space out 9 and drill collar 8.

Figure 9:
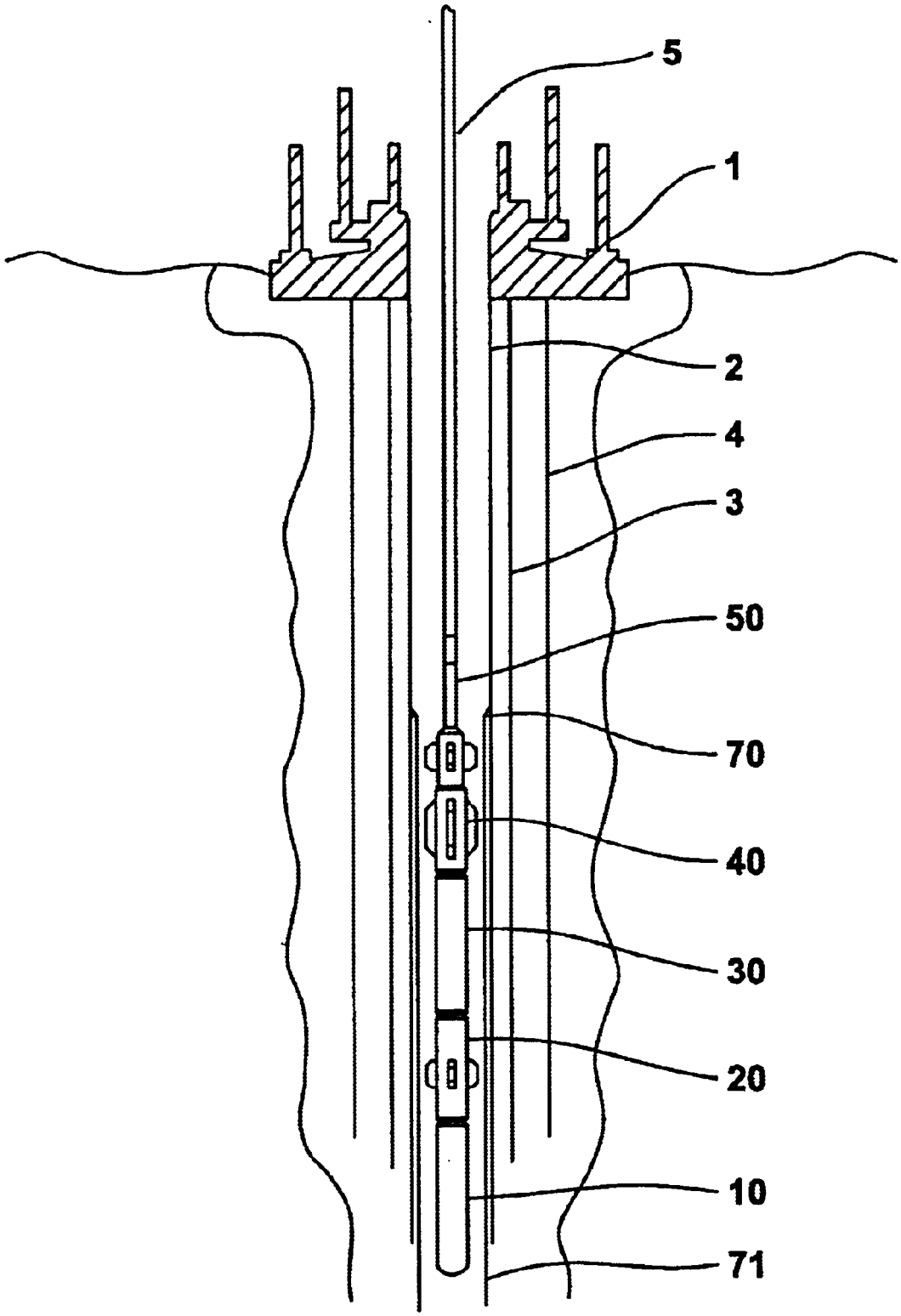
FIG. 9 is a side view of a cut/retrieval tool positioned within a downhole casing string that is hung-off below the wellhead.

Referring to FIG. 9, an alternative embodiment of the invention is shown for cutting downhole casing. this embodiment of the invention is similar to those previously disclosed except that the cut/retrieval tool 7 does not comprise a seal assembly retrieval tool. Rather, the cut/retrieval tool 7 only comprises a bumper jar 50, a spear 40, a long stroke bumper jar 30, a mud motor 20 and a casing cutter 10 as shown in FIG. 9. The downhole casing string 71 is hung from the interior casing 2 at a location below the wellhead 1 by slips 70. Since slips 70 are used to hang the downhole casing string 71, there is no seal assembly to be pulled. The cut/retrieval tool 7 of the present invention may be used in this off-shore application because the spear 40 engages the casing 71 to create a tension point between the tool and the casing, i.e., there is no need to land the tool in the casing. Because the spear 40 creates a tension point, any heave action on the production vessel located at the ocean surface is eliminate. The spear 40 holds the tool 7 at a constant depth during the cutting process. A further benefit is that the casing may be cut many times at different depths. For example, if a long section of casing is cut for removal but will no free itself after being cut, the tool 7 may be repositioned further up the hole to cut and retrieve a smaller section of the casing.

While the particular embodiments for cut and retrieval well casing systems as herein shown and disclosed in detail are fully capable of obtaining the objects and advantages hereinbefore stated, it is to be understood that they are merely illustrative of the preferred embodiments of the invention and that no limitations are intended by the details of construction or design herein shown other than as described in the appended claims.

What is claimed is:

1. A well abandonment process for cutting and retrieving an offshore well casing, the process comprising:

making a trip to the well wherein the following steps are performed, the steps comprising:

pulling a seal assembly from the wellhead, cutting the casing, griping the casing so that the casing is held in tension during said cutting the casing, and retrieving the seal assembly and cut casing.

2. The process of claim 1, wherein the pulling a seal assembly from the wellhead comprises engaging the seal assembly with a seal assembly retrieval tool and raising the seal assembly retrieval tool above the wellhead, whereby the seal assembly is pulled from the wellhead.

3. The process of claim 1, wherein said cutting the casing comprises:

positioning a casing cutter at a desired cut depth;

engaging a spear with the casing; and operating the casing cutter.

4. The process of claim 1, wherein said gripping the casing comprises:

positioning a spear below the wellhead; and manipulating the spear, whereby the spear grips the casing.

5. The process of claim 1, wherein said retrieving the seal assembly and cut casing comprises raising the seal assembly and the cut casing from the well to the surface of the water above the offshore well.

6. An apparatus for cutting and retrieving an offshore well casing, said apparatus comprising:

a seal assembly retrieval tool for releasing a seal assembly of the well casing, wherein said seal assembly retrieval tool is connectable to a drill string for suspension from the drill string;

a spear in mechanical communication with said seal assembly retrieval tool, wherein said spear is engageable with the well casing;

a mud motor in mechanical communication with said spear; and a casing cutter in mechanical communication with said mud motor, wherein said casing cutter is driven by said mud motor to cut the well casing.

7. The apparatus as claimed in claim 6, further comprising a spear bumper jar in mechanical communication with said seal assembly retrieval tool and said spear, wherein the mechanical communication of said spear and said seal assembly retrieval tool is through said spear bumper jar.

8. The apparatus as claimed in claim 6, further comprising a mud motor bumper jar in mechanical communication with said spear and said mud motor, wherein the mechanical communication of said mud motor and said spear is through said mud motor bumper jar.

9. The apparatus as claimed in claim 7, further comprising a mud motor bumper jar in mechanical communication with said spear and said mud motor, wherein the mechanical communication of said mud motor and said spear is through said mud motor bumper jar, wherein the stroke of the mud motor bumper jar is longer than the stroke of the spear bumper jar.

10. The apparatus as claimed in claim 6, further comprising a drill collar in mechanical communication with the seal assembly retrieval tool and the spear.

11. The apparatus as claimed in claim 6, further comprising a drill pipe space out in mechanical communication with the seal assembly retrieval tool and the spear.

12. An apparatus for cutting and retrieving an offshore well casing, said apparatus comprising:

a seal assembly retrieval tool for releasing a seal assembly of the well casing, wherein said seal assembly retrieval tool is connectable to a drill string for suspension from the drill string;

a first bumper jar in mechanical communication with said seal assembly retrieval tool;

a spear in mechanical communication with said first bumper jar, wherein said spear is engageable with the well casing;

a second bumper jar in mechanical communication with said spear;

a mud motor in mechanical communication with said second bumper jar; and a casing cutter in mechanical communication with said mud motor, wherein said casing cutter is driven by said mud motor to cut the well casing.

* * * * *